US007523582B1

(12) United States Patent
Ahrens et al.

(10) Patent No.: US 7,523,582 B1
(45) Date of Patent: Apr. 28, 2009

(54) PRECISION LASER AIMING SYSTEM

(75) Inventors: Brandon R. Ahrens, Albuquerque, NM (US); Steven N. Todd, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 11/838,466

(22) Filed: Aug. 14, 2007

Related U.S. Application Data

(60) Provisional application No. 60/839,005, filed on Aug. 21, 2006.

(51) Int. Cl.
*F41G 1/00* (2006.01)

(52) U.S. Cl. ..... 42/115; 33/286

(58) Field of Classification Search ..... 42/115, 42/116, 121; 33/227, 228, 263, 286, 290, 33/265, 266
See application file for complete search history.

(56) References Cited

U.S. PATENT DOCUMENTS 4,106,207 A * 8/1978 Boyett et al. ..... 33/286
4,206,550 A * 6/1980 Boyett et al. ..... 33/286
4,764,010 A * 8/1988 Bachmann et al. ..... 33/286
4,777,754 A 10/1988 Reynolds, Jr.
4,876,816 A 10/1989 Triplett
5,033,219 A * 7/1991 Johnson et al. ..... 42/115
5,060,391 A * 10/1991 Cameron et al. ..... 42/115
6,366,344 B1 * 4/2002 Lach ..... 33/265
6,490,957 B1 12/2002 Alexander
6,539,638 B1 * 4/2003 Pelletier ..... 33/290
6,644,166 B2 11/2003 Alexander
2006/0156560 A1 * 7/2006 Lines et al. ..... 33/265
2008/0276473 A1 * 11/2008 Raschella et al. ..... 33/286

* cited by examiner

*Primary Examiner*—Michael Carone
*Assistant Examiner*—Jonathan C Weber
(74) *Attorney, Agent, or Firm*—Elmer A. Klavetter

(57) ABSTRACT

A precision laser aiming system comprises a disrupter tool, a reflector, and a laser fixture. The disrupter tool, the reflector and the laser fixture are configurable for iterative alignment and aiming toward an explosive device threat. The invention enables a disrupter to be quickly and accurately set up, aligned, and aimed in order to render safe or to disrupt a target from a standoff position.

23 Claims, 7 Drawing Sheets

PRECISION LASER AIMING SYSTEM

CROSS REFERENCE TO RELATED APPLICATIONS

This application claims the priority under 35 U.S.C. § 119(e)(1) of co-pending provisional application Ser. No. 60/839,005 filed Aug. 21, 2006 and incorporated by reference in its entirety.

STATEMENT REGARDING FEDERALLY SPONSORED RESEARCH OR DEVELOPMENT

This invention was developed under Contract DE-AC04-94AL85000 between Sandia Corporation and the U.S. Department of Energy. The U.S. Government has certain rights in this invention.

FIELD OF THE INVENTION

This invention generally relates to the setup and application of disruptors and similar systems that provide the capability to render safe or disrupt explosive device threats from a standoff position, and more specifically, to the quick and accurate alignment and aiming of a disrupter tool (or disruptors) with a target.

BACKGROUND

A challenge for the effective implementation of disrupting systems is the quick and accurate alignment and aiming of the disrupter tool with a critical, explosive target. This invention was developed to simplify the process of aiming disrupting systems that are currently being used. Compared to previous setup, alignment and aiming systems and processes, this invention enables simple, fast and accurate alignment and aiming of one or more types of disrupter tools with explosive targets. In addition, the components of this invention are designed to be lightweight and compact while also providing the accuracy that is necessary for intended applications.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

To address certain problems unmet by existing systems and processes, various embodiments of the present invention described herein may comprise the precision laser aiming system invention. In addition, various method embodiments may be implemented to configure and iteratively setup the invention for quick and accurate alignment and aiming of a disrupter tool with an explosive device target.

Figure 1:
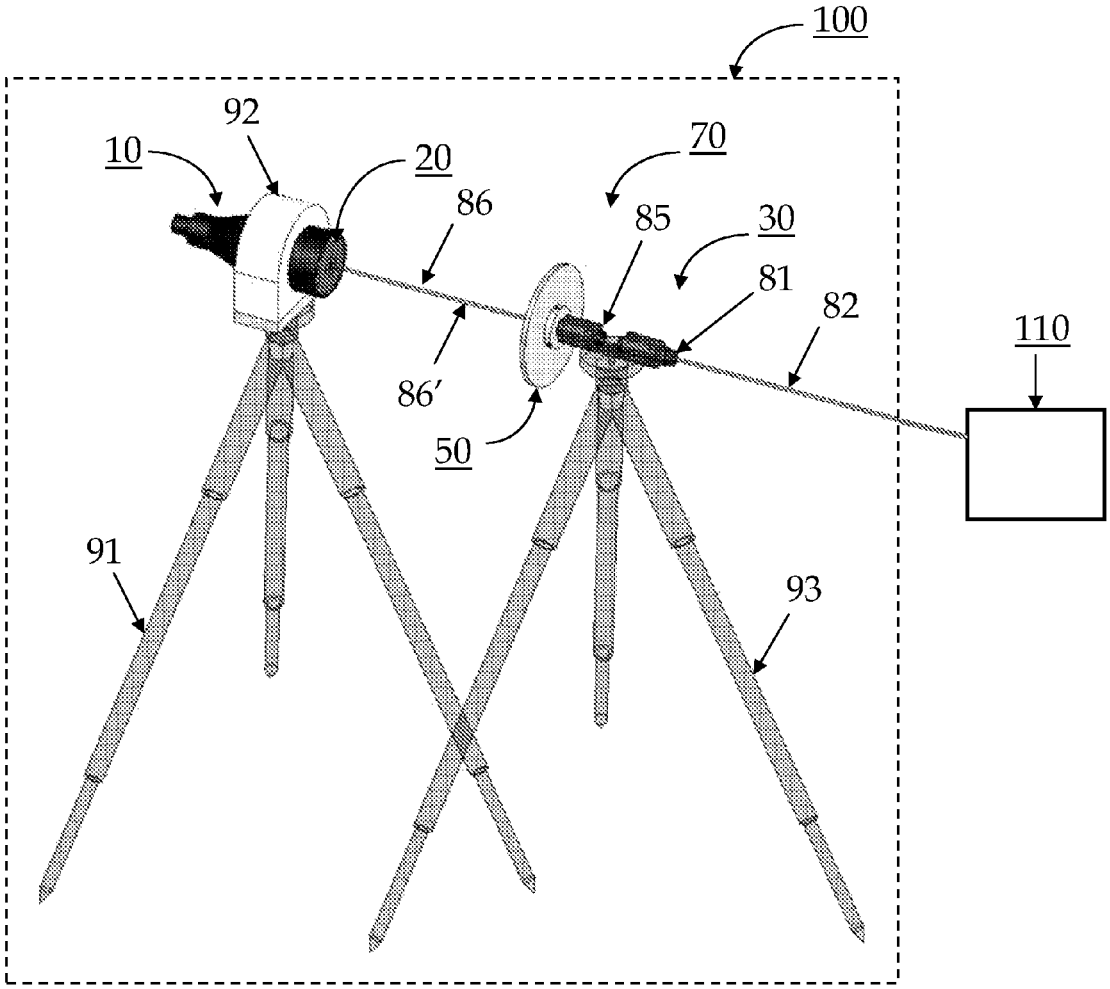
FIG. 1 illustrates an embodiment of the invention comprising a mounted Viper disrupter tool, a reflector, and a mounted laser fixture.

As shown in one embodiment of the invention illustrated in FIG. 1 (with further illustration details shown in FIGS. 3A-3B), the invention 100 comprises a disrupter tool 10, a mounting apparatus 91 for positioning the disrupter tool 10, a reflector 20 operatively attached to the disrupter tool 10, a laser fixture 70 (consisting of a laser support structure 30, a laser 81, a laser 85, and a laser finding plate 50), a laser beam 86, a laser beam 82, and a mounting apparatus 93 for positioning the laser fixture. Similarly, as shown in another embodiment of the invention illustrated in FIG. 2 (with further illustration details shown in FIGS. 3A-3B), the invention 100' comprises a disrupter tool 10', a mounting apparatus 91 for positioning the disrupter tool 10', a reflector 20' operatively attached to the disrupter tool 10', a laser fixture 70 (consisting of a laser support structure 30, a laser 81, a laser 85, and a laser finding plate 50), a laser beam 82, a laser beam 86, and a mounting apparatus 93 for positioning the laser fixture 70. Laser beams 82 and 86 are utilized in various embodiments for aligning and aiming the disrupter tool toward an explosive device target 110 in FIG. 1, and toward an explosive device target 110' in FIG. 2.

Figure 2:
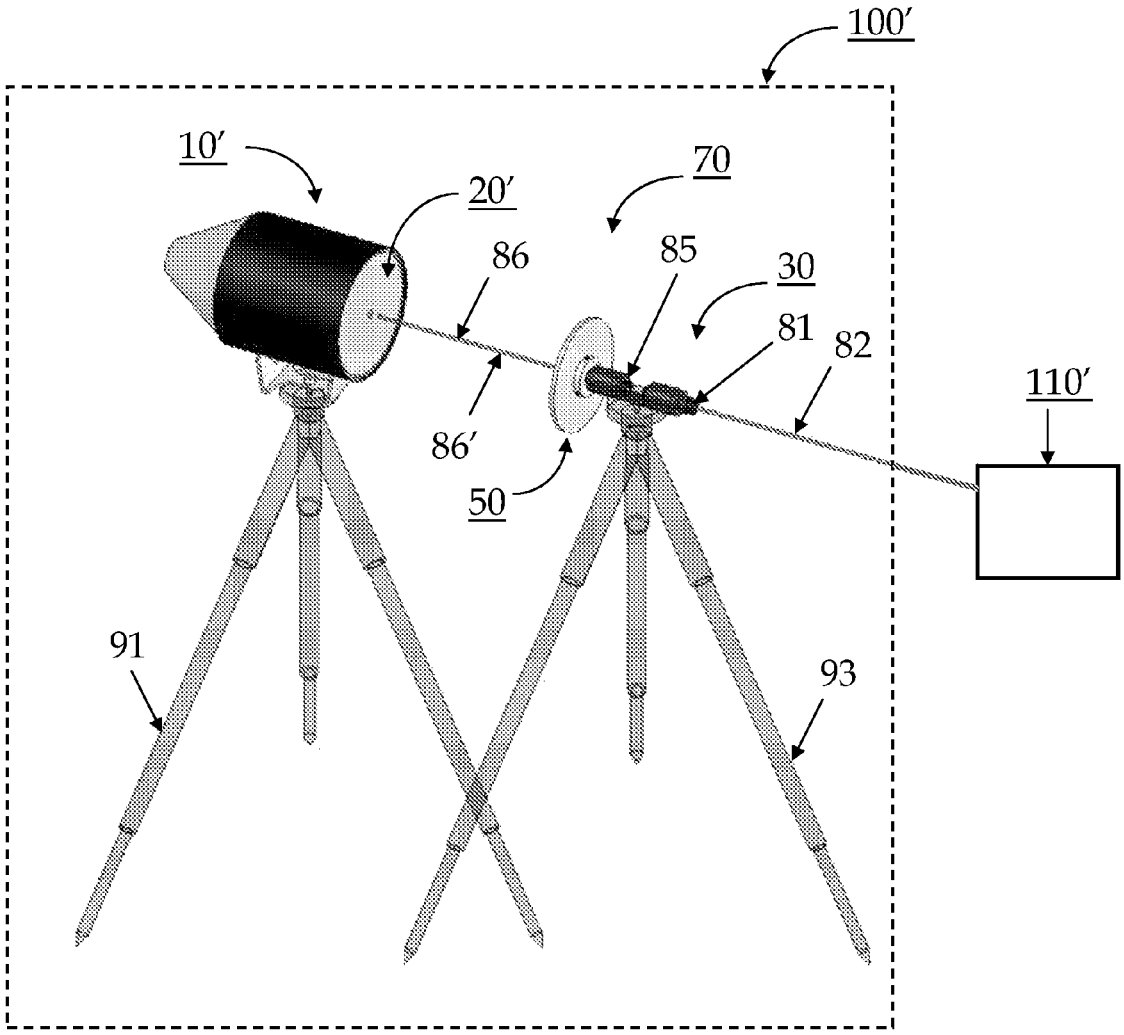
FIG. 2 illustrates an embodiment of the invention comprising a mounted Tow disrupter tool, a reflector, and a mounted laser fixture.
Figure 3A:
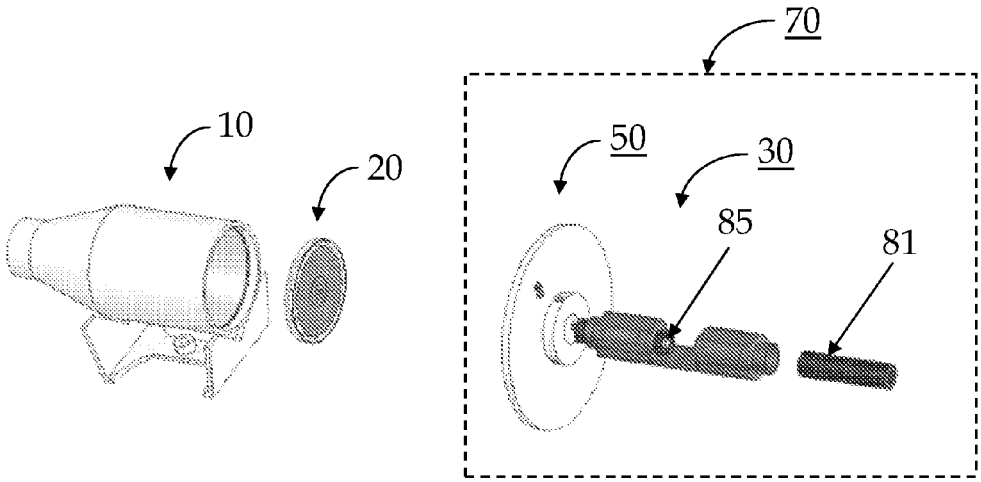
FIGS. 3A and 3B illustrate a partially exploded view in accordance with an embodiment of the invention comprising an unmounted Viper disrupter tool, a reflector, and an unmounted laser fixture.
Figure 3B:
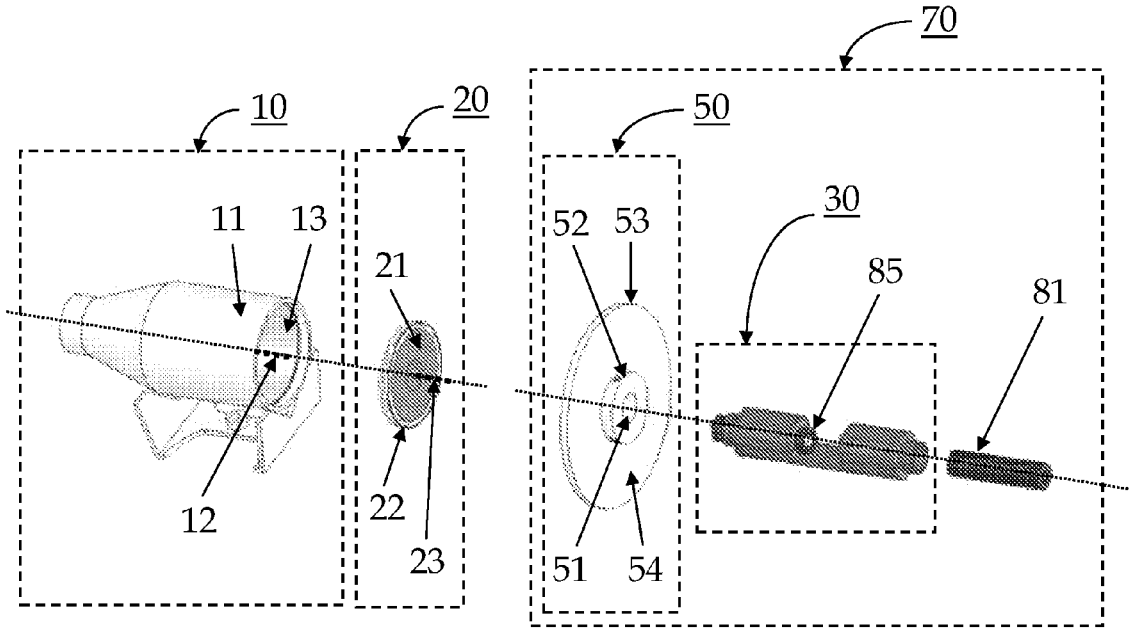

Various disrupter tools may be utilized with various embodiments of the invention including non-electric explosive ordnance disposal disruptors (e.g., Percussion Actuated Non-electric (PAN) disrupter tool), barrel firing disruptors, and as shown in FIG. 1 (i.e., a Viper disrupter tool), FIG. 2 (i.e., a TOW disrupter tool), and FIGS. 3A-3B, various shaped-charge disruptors. For various embodiments of the invention (as shown in FIG. 3B), a disrupter tool 10 comprises a muzzle 11, a muzzle axis 12 that extends in a collinear orientation along the z-axis center of the muzzle 11, and a muzzle opening 13 at the exit end of the muzzle 11. A disrupter tool is "roughly aimed" when its muzzle is positioned and generally aimed by an operator towards a target without assist of add-on or external active equipment such as lasers. For various embodiments of the invention, after aligning and aiming a disrupter tool to a target, the reflector generally remains operatively attached to the disrupter tool (i.e., not removed) during disrupter firing. Note that the term "disrupter" may also be identified as "disrupter" in the art.

Reflectors are generally inexpensive to make, yet capable of supporting the accurate alignment and aiming of a disrupter tool. In one embodiment as shown in FIGS. 3A and 3B, the reflector is a machined piece of a highly-durable, polycarbonate resin thermoplastic (or similar material) possessing a reflective surface (i.e., reflective broadside 21) on at least one of its two broadsides. In various embodiments, the reflective broadside 21 may be formed on the reflector 20 by attaching a mirror to, or by depositing a mirrored surface onto, at least one of the broadsides of the reflector.

In various embodiments (an example of an embodiment is illustrated in FIGS. 3A and 3B), the reflector 20 comprises a reflective broadside 21, and a reflector attaching means 22 that is adapted to operatively attach the reflector 20 over a muzzle opening 13 (e.g., operative attachment of the reflector either to the inside surface of, to the edge of, or to the outside surface of the muzzle opening 13), and a reflective axis 23 that extends in a collinear orientation along the z-axis center of the reflector such that the reflective axis 23 is orthogonal to the reflective broadside 21 of the reflector. The reflector attaching means 22 may be comprised of any of a variety of attaching interfaces including threaded, press-fit, adhesives, bands, clamps, or other attaching interfaces capable of operatively attaching the reflector to the disrupter tool.

Figure 4A:
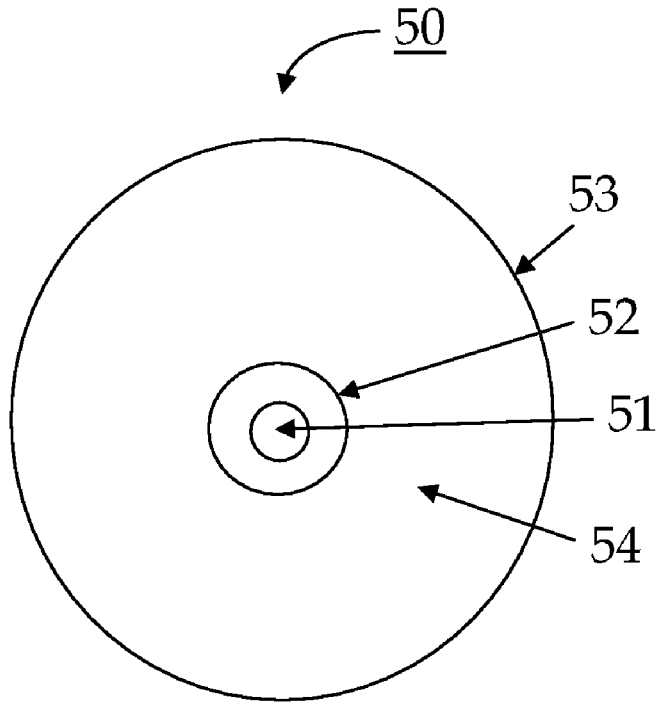
FIGS. 4A and 4B illustrate the broadside views of an embodiment of the laser finding plate.

The laser fixture integrates many of the components useful for aligning and aiming the disrupter tool to the target. In various embodiments (as illustrated in FIGS. 3A and 3B), the laser fixture 70 comprises: a laser support structure 30; two compact lasers (i.e., a laser 81 and a laser 85); and a laser finding plate 50, and at least one power source for operating the lasers (although the power source(s) is/are most often integrated within the lasers). The laser finding plate 50 comprises at least one laser finding plate attaching means 52 (as shown in FIGS. 3A, 3B, and 4A) that is capable of securing the laser finding plate 50 to one end of the laser support structure 30 during alignment and aiming, and then releasing the laser finding plate 50 after alignment and aiming. Note that the laser fixture is removed from the laser fixture setup area before the firing of the disrupter tool.

The laser support structure (as well as the overall laser fixture) is sufficiently rugged to endure some shock and rough handling during setup for targeting scenarios (e.g., shock and handling may be similar to those encountered in a military environment), and is a generally rigid structure that is formed to house and to securely hold the two compact lasers. In one embodiment as illustrated in FIGS. 5A-5D, the laser support structure 30 may be formed by the machining of a single piece of aluminum, and in other embodiments, the laser support structure may be formed by machining suitable rigid metals other than aluminum, or by the similar forming of other suitable rigid materials.

In embodiments of the invention as illustrated in FIGS. 5A-5D, and FIGS. 6A-6B, the laser support structure 30 is formed with dual cavities for housing two lasers (laser 81 and laser 85), as well as is formed to act as a clamp for securing the two lasers whose beams (laser beam 82 and laser beam 86, respectively) are aligned to be collinear (as shown by the collinear line indicator 87 in FIG. 6B) but directed outward in opposite directions. As shown in FIGS. 5A-5D, a first end cavity 48 and a second end cavity 48' are formed to enable the insertion and the housing of laser 81 and laser 85, respectively.

In an embodiment of the invention as illustrated in FIGS. 5A-5D, a slit 38 is evacuated along at least one longitudinal side (formed by 39 and 39') of the laser support structure 30. As illustrated in the end view of FIG. 5D, the evacuated slit 38 accommodates the clamp-like arrangement of the laser support structure 30 for securing and aligning the lasers 81 and 85 (see FIGS. 3A-3B and FIGS. 6A-6B). Four holes are evacuated from the laser support structure: 37, 37', 37", and 37''', and are pairwise aligned with threaded holes in the laser support structure: 36, 36', 36", and 36''', respectively. The four holes accommodate the insertion of, generally, four adjustment screws: 31, 31', 32, and 32' through the evacuated holes, and accommodate the adjustment screws to be engaged into the threaded holes 36, 36', 36", and 36''', respectively. The adjustment screws 31 and 31' comprise a first set of adjustment screws, and the adjustment screws 32 and 32' comprise a second set of adjustment screws.

The action of the adjustment screws assist at least two important functions of the invention: they support the clamping of the laser support structure 30 for securing the lasers 81 and 85; and they support the relative adjustment of the lasers beams 82 and 86 for alignment in a mutually collinear manner. For example, after laser 81 is inserted into the first end cavity 48 and laser 85 is inserted into the second end cavity 48', and as the adjustment screws 31, 31', 32, and 32' are tightened, the width of the slit 38 decreases in a clamp-like fashion to secure the lasers 81 and 85 within the laser support structure 30; and conversely, as the adjustment screws are loosened, the width of the slit 38 increases, and the lasers are unsecured for removal.

Note that the adjustment action of a tightening action or a loosening action of the first set of adjustment screws (31 and 31') either secures or unsecures the laser 81. Similarly, note that the adjustment action of a tightening action or loosening action of the second set of adjustment screws (32 and 32') either secures or unsecures the laser 85. In addition, the proper adjustment of the first set of adjustment screws may also accommodate proper collinear alignment of laser beam 86 of laser 85 with laser beam 82 of laser 81 (as illustrated in FIGS. 3A-3B and FIGS. 6A-6B). Similarly, the proper adjustment of the second set of adjustment screws also accommodates proper collinear alignment of laser beam 82 of laser 81 with laser beam 86 of laser 85 (as illustrated in FIGS. 3A-3B and FIGS. 6A-6B).

Figure 5A:
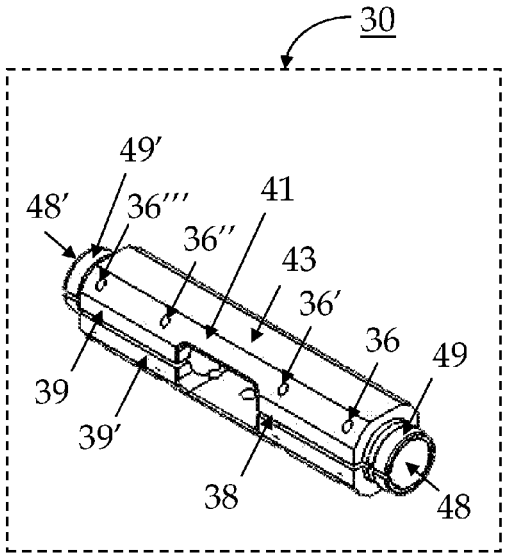
FIGS. 5A, 5B, 5C, and 5D illustrate isometric views of the laser support structure in accordance with an embodiment of the invention.
Figure 5B:
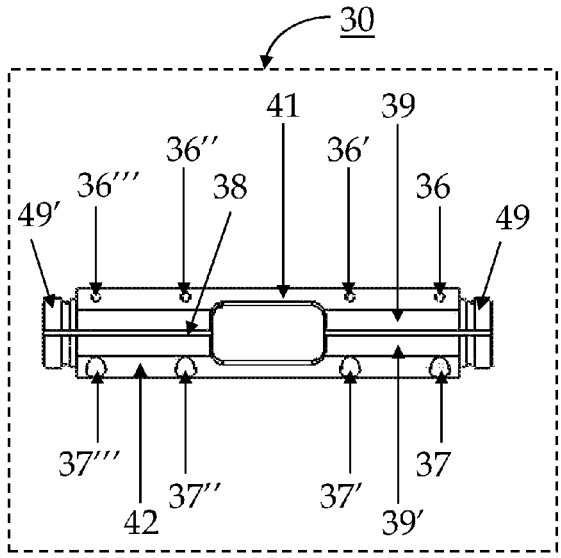
Figure 5C:
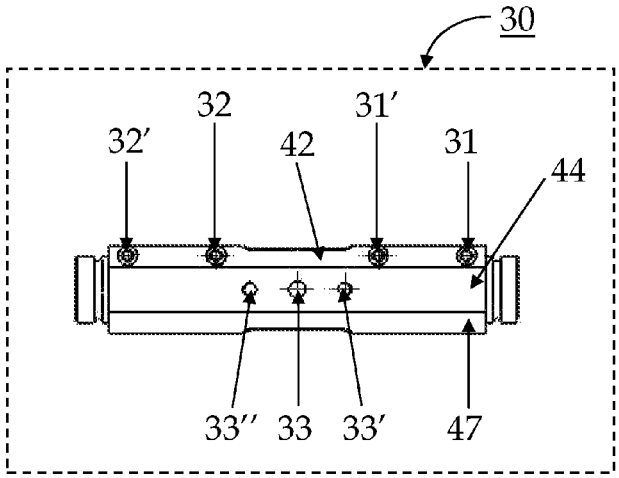
Figure 5D:
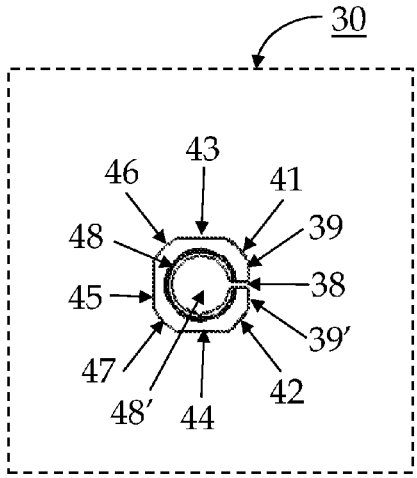
Figure 5E:
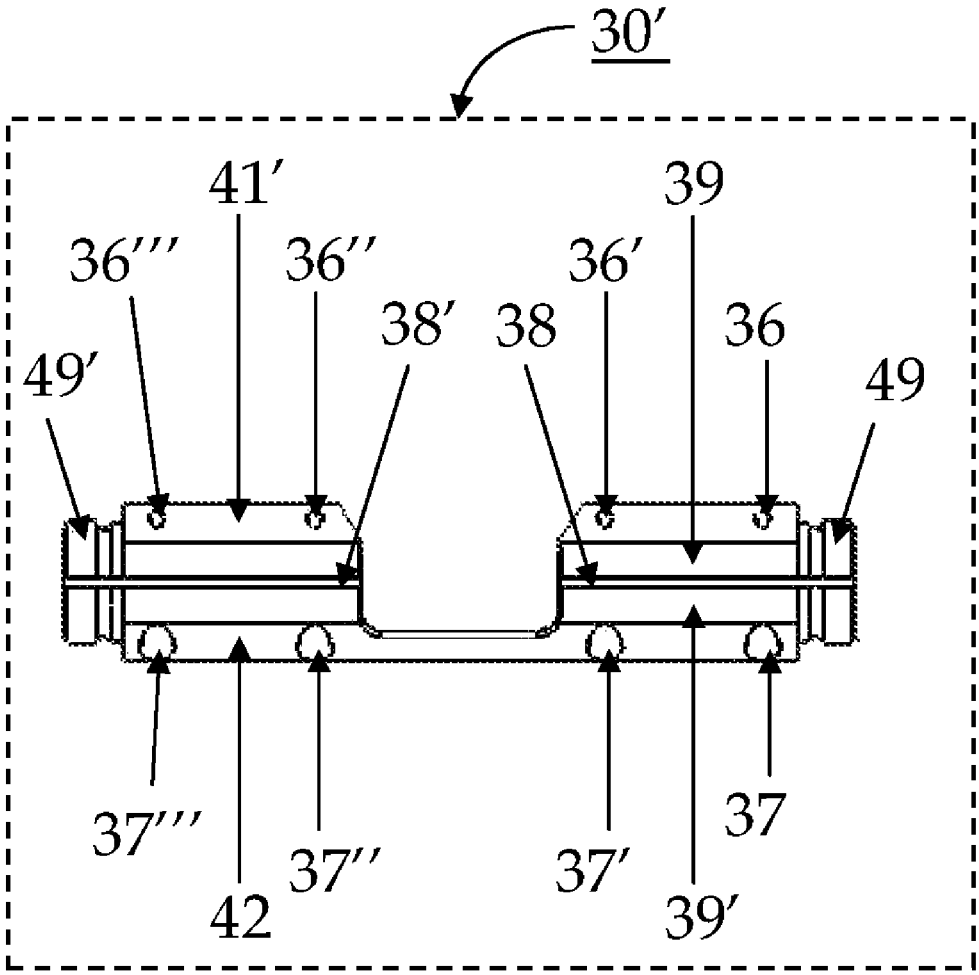
FIG. 5E illustrates a side view of the laser support structure in accordance with another embodiment of the invention.
Figure 6A:
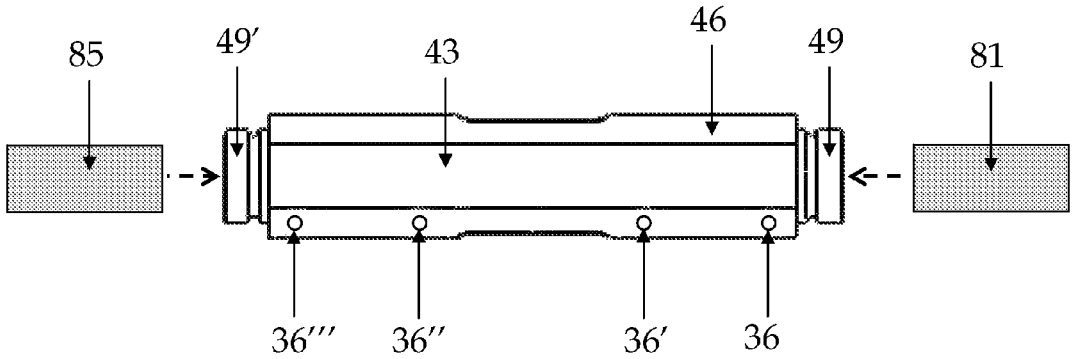
FIGS. 6A and 6B illustrate top views of laser support structure showing insertion of lasers into, and secured lasers within the laser support structure.
Figure 6B:
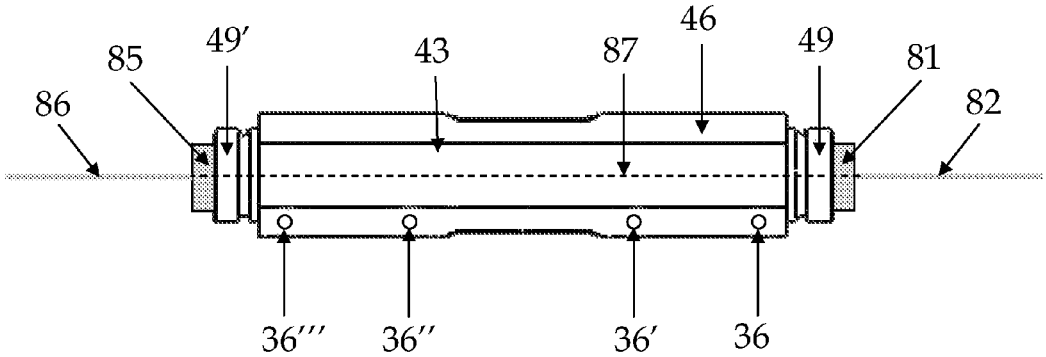

In one embodiment as illustrated in the bottom view in FIG. 5C, the laser support structure 30 has at least one threaded hole 33 evacuated generally located in the center of the bottom side 44 of the structure; the threaded hole 33 is capable of attachment to a corresponding mounting screw on a mounting apparatus. Additional threaded holes 33' and 33" may also be evacuated in the laser support structure 30 as needed for mounting attachment. The threads of each threaded hole are adapted to receive a mounting screw from a mounting apparatus, and accommodate mounting of the laser support structure and, therefore, the laser fixture, to a standard camera tripod or similar mount as desirable for a particular application.

In an embodiment of a laser support structure 30 illustrated in FIGS. 5A-5D, when viewed from either of its two end surfaces, the laser support structure 30 has generally flat surfaces for the bottom 44, the top 43, as well as for the side surface 45, and for the side surface formed by the combination of side surface 39 and side surface 39'. In one embodiment of a laser support structure 30, beveled surfaces 41, 42, 46, and 47, may also be formed between the top and the side surfaces, and between the bottom and the side surfaces, to reduce the number of sharp edges on the laser support structure 30. Other embodiments of the laser support structure may contain only the top 43, the bottom 44, the side 45, and the side formed by 39 and 39', without any of the previously described beveled surfaces. Note that in another embodiment illustrated in FIGS. 1, 2, 3A-3B, and 5E, a shank-like portion may also be removed from the top 43 surface of the laser support structure 30.

The bottom surface 44 of the laser support structure 30 is positioned orthogonally with respect to the side surface 45, as well as with respect to the surfaced formed by 39 and 39'. The formation of generally flat outer surfaces on the laser support structure, as well as the formation of generally orthogonal surfaces between the bottom surface 44 relative to the side surface 45, and to the side surface formed by 39 and 39', as well as for the top surface 43 relative to the side 45, and to the side formed by 39 and 39', accommodates stabilizing and positioning the laser fixture during the laser alignment process. As an example, generally flat outer surfaces and generally orthogonal surfaces between top and sides and between bottom and sides support stabilizing and positioning a laser fixture on a flat surface or against a rail, when not mounted on a mounting apparatus such as a camera tripod.

Figure 4B:
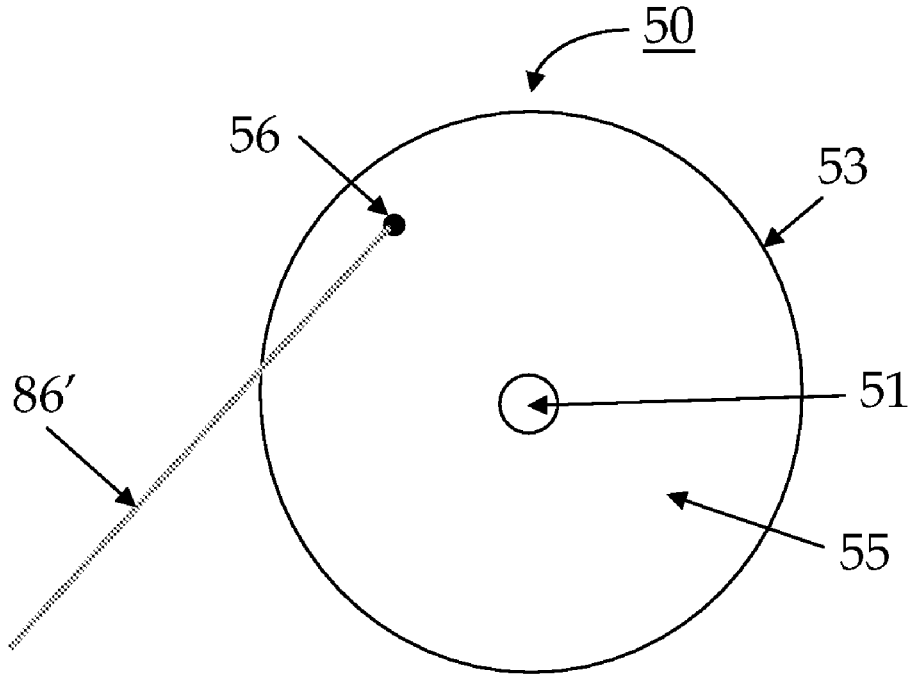

In various embodiments shown in FIGS. 3A, 3B, 4A and 4B, the laser finding plate 50 comprises two broadsides (i.e., broadside 54 is directed towards the target as shown in FIGS. 3B and 4A; and broadside 55 is directed toward the disrupter tool as shown in FIG. 4B); a center hole 51; a laser finding plate attaching means 52; and an outer edge 53. In various embodiments shown in FIGS. 1, 2, 3A-3B, 4A, and 5A-5B, the laser finding plate 50 may be adapted to attach to either of the ends (i.e., end 49 or end 49') of the laser support structure 30 via a laser finding plate attaching means 52. As such, the laser finding plate attaching means 52 is generally complementary to the structure of at least one of the ends of the laser support structure 30. The laser finding plate attaching means 52 may be configured as any of a variety of attachment interfaces (e.g., threaded interfaces, press-fit interfaces, clamps, plates, bands, adhesives, or other similar interfaces) capable of accommodating the attaching of the laser finding plate 50 with the laser support structure 30 for aligning and aiming, as well as the releasing of the laser finding plate 50 after aligning and aiming.

As illustrated in an embodiment shown in FIGS. 4A-4B and as described previously, the laser finding plate 50 has two broadsides: the broadside 55 aides in locating a reflection of one of the laser fixture's laser beams from a reflector 20, and the laser finding plate attaching means 52 is configured on the opposite broadside (i.e., broadside 54) for attaching the laser finding plate 50 to the laser support structure 30. As an example, in an embodiment illustrated in FIG. 1, the laser beam 86 is transmitted by laser 85 towards the reflector 20 (i.e., the reflector 20 is operatively attached to the disrupter tool 10), and the laser beam 86 is reflected off of the reflective broadside 21 of the reflector 20 as reflected laser beam 86' back towards the laser finding plate 50. In a "fine aligning" process described in a later section, the laser fixture 70 is moved in small increments until the reflected laser beam 86' "hits" the broadside 55 of the laser finding plate 50 at an "aligning hit" point 56 (as shown in FIG. 4B).

Iterations of "fine aligning" the laser fixture 70 and "fine aiming" (described in a later section) of the disrupter tool 10 may result in a "sufficiently aligned and aimed disrupter tool" when the reflected laser beam 86' hits an "aligning hit" point 56 that, according to the requirements of a targeting application, is sufficiently close to the center hole 51 of the laser finding plate 50. Or, iterations of "fine aligning" the laser fixture 70 and "fine aiming" of the disrupter tool 10 may result in a "completely aligned and aimed disrupter tool" when the reflected laser beam 86' is directed until it aligns through the center hole 51 of the laser finding plate 50. Additional details on the alignment and aiming of the disrupter tool are provided in the later section "METHOD FOR USE OF THE INVENTION."

As shown in embodiments in FIGS. 3B, 4A and 4B, the center hole 51 is evacuated in the general center of the laser finding plate 50, the evacuation extending completely through the center of the laser finding plate 50. Generally, laser finding plates with outer edge 53 diametric sizes of two inches (for applications with a generally short distance between the disrupter tool and the target) and four inches (for applications with a generally long distance between the disrupter tool and the target) have been used during setup, aligning and aiming of the invention. However, other outer edge 53 diametric sizes may be utilized that are suitable for the requirements of the application of the invention.

As described above, in addition to the laser finding plate 50, the reflector 20 is an essential component of the invention that accommodates alignment and aiming of the disrupter tool by providing a reflective surface (i.e., reflective broadside 21) for reflecting an aligning and aiming laser beam. As shown in FIGS. 1, 2, and 3A and 3B, during alignment and aiming, the reflective broadside 21 of the reflector 20 enables reflection of the incident laser beam 86 back towards the laser fixture 70 as the reflected laser beam 86', and the beam 86' may generally strike the laser finding plate 50 at an outer "aligning hit" point 56 (as shown in FIG. 4B) on the laser finding plate 50; an outer "aligning hit" point is a striking point on the laser finding plate 50 by the reflected laser beam 86' that is located closer to the outer edge 53 than to the center hole 51 of the laser finding plate 50. As corrections in disrupter tool positioning, alignment and aiming are made, the "aligning hit" point of the reflected laser beam 86' generally moves from the proximity of the outer edge of the laser finding plate towards the center hole 51 of the laser finding plate 50 until the disrupter tool is either "sufficiently aligned and aimed" or "completely aligned and aimed". After alignment and aiming of the disruptor tool 10 to a target 110, the reflector 20 should remain operatively attached to the disruptor tool 10 (i.e., not removed) and may be destroyed upon firing of the disruptor tool.

METHOD FOR USE OF THE INVENTION

The various parts of the present invention work in conjunction to create an easy, fast and effective capability for the setup, aligning, and aiming of a disruptor tool with a target. In embodiments illustrated in FIG. 1 and FIGS. 3A and 3B, a disruptor tool 10 is stabilized and may be mounted on a mounting apparatus 91. The disruptor tool 10 comprises a muzzle 11, a muzzle axis 12 that extends in a collinear orientation along the z-axis center of the muzzle 11, and a muzzle opening 13 at the exit end of the muzzle 11. A reflector 20 comprises a reflective broadside 21, a reflector attaching means 22, and a reflective axis 23 that extends in a collinear orientation along the z-axis center of the reflector such that the reflective axis 23 is orthogonal to the reflective broadside 21 of the reflector. After the reflective broadside 21 of the reflector 20 is positioned away from the disruptor tool 10 and towards a target 110, the reflective axis 23 is aligned collinearly with the muzzle axis 12, and the reflector 20 is operatively attached via a reflector attaching means 22 over the muzzle opening 13 of the disruptor tool 10. The disruptor tool 10 is then positioned such that its muzzle 11 is generally aimed by an operator at a target 110 without assist of add-on or external active equipment such as lasers; this positioning and general aiming constitutes "rough aiming" of the disruptor tool 10 by the operator.

In embodiments illustrated in FIGS. 1, 3A and 3B, a laser fixture 70 is stabilized and may be mounted on a mounting apparatus 91 or may be secured to another stable apparatus or structure. The laser fixture 70 is positioned along a visual line between the disrupter tool 10 and the target 110, and generally midway between the disrupter tool 10 and the target 110. A first laser beam 82 of laser 81 is directed until it "hits" a desirable location ("target hit") on the target 110.

To improve the "rough alignment" of the disrupter tool, an operator executes the following process steps for "fine alignment" of the laser fixture. While maintaining the "target hit" position of the first laser beam 82 on the target 110, the laser fixture 70 is moved in generally small increments (e.g., up, down, and/or either side) and positioned until a second laser beam 86 (as shown in FIG. 1) is directed towards and "hits" a first "reflective point" on the reflective broadside 21 of the reflector 20, and the reflected laser beam 86' is directed back towards the laser fixture 70. While continuing to maintain the "target hit" position of the first laser beam 82 on the target 110, the laser fixture 70 may be further moved in generally small increments (e.g., up, down, and/or either side), and the second laser beam 86 "hits" a second "reflective point" on the reflective broadside 21 such that the reflected laser beam 86' is directed back towards the laser finding plate 50, and as shown in FIGS. 4A and 4B, the reflected laser beam 86' "hits" the laser finding plate 50 at a first outer "aligning hit" point 56 on the laser finding plate 50.

Further, while continuing to maintain the "target hit" position of the first laser beam 82 on the target 110, the laser fixture 70 may be moved still further in generally small increments (e.g., up, down, and/or either side), and the second laser beam 86 "hits" a third "reflective point" on the reflective broadside 21 such that the reflected laser beam 86' is directed back towards the laser finding plate 50, and the reflected laser beam 86' "hits" a next "aligning hit" point 56 on the laser finding plate 50 such that the next "aligning hit" point is closer to the center hole 51 of the laser finding plate 50 than the first or previous "aligning hit" point(s). Further small incremental moves of the laser fixture 70 may continue until the "aligning hit" point 56 of the reflected laser beam 86' is sufficiently close to the center hole 51 of the laser finding plate 50 according to the requirements of a targeting application, and determines a "sufficiently aligned and aimed disrupter tool". Or, the further small incremental moves of the laser fixture 70 may continue until the reflected laser beam 86' aligns through the center hole 51 of the laser finding plate 50 and determines a "completely aligned and aimed disrupter tool".

If, after "fine aligning" process steps described above, the disrupter tool 10 is neither "sufficiently aligned and aimed" or "completely aligned and aimed", and an operator intends to further improve the "rough aiming" of the disrupter tool 10 or the "fine aligning" of the laser fixture 70, the operator may execute the following additional process steps for "fine aiming" of the disrupter tool 10. According to "fine aiming", the disrupter tool 10 is moved in generally small increments (e.g., up, down, and/or either side) and positioned until the reflected laser beam 86' contacts the laser finding plate 50 at an "aligning hit" point 56 that is sufficiently close to the center hole 51 of the laser finding plate 50 according to the requirements of a targeting application, and determines a "sufficiently aligned and aimed disrupter tool". Or, the disrupter tool 10 is moved in generally small increments (e.g., up, down, and/or either side) and positioned until the reflected laser beam 86' is directed through the center hole 51 of the laser finding plate 50 and the disrupter tool 10 is "completely aligned and aimed".

Additional iterative movements for the "fine aligning" steps of the laser fixture 70 and for "fine aiming" steps of the disrupter tool 10 as described above may continue until the disrupter tool 10 is either "sufficiently aligned and aimed" according to the requirements of the application, or "completely aligned and aimed". Note that the steps for the "fine alignment" of the laser fixture 70 and the "fine aiming" of the disrupter tool 10 described above may be executed in any order, depending upon the operator's preference, to either "sufficiently aligned and aimed" or "completely aligned and aimed".

Once the disrupter tool 10 has been either "sufficiently aligned and aimed" or "completely aligned and aimed" with the target 110, the disrupter tool 10 and reflector 20 are left untouched (i.e., the reflector 20 generally remains operatively attached to the disrupter tool 10). The laser fixture 70 is removed from the laser fixture setup area, and the disrupter tool 10 may then be fired at the target 110.

As described above, the reflector is generally not removed from the disrupter tool after "sufficiently aligned and aimed" or "completely aligned and aimed", and the reflector is destroyed upon firing of the disrupter tool. Since it is removed from the laser fixture setup area before firing the disrupter tool, however, the laser fixture may be reused in numerous subsequent application scenarios. The operator may optionally choose to remove the reflector after it is aligned and aimed and before firing the disrupter tool, however, to do so, risks introducing undesirable movement to and repositioning of the disrupter tool leading to potential misalignment and mis-aiming of the disrupter tool with the target.

Maintaining operative attachment of the reflector to the disrupter tool provides advantages over other systems and processes currently used for disrupter tool alignment and aiming. For example, since the reflector is a relatively inexpensive item, the cost of the destruction of the reflector during disrupter tool firing is inconsequential compared to systems and processes utilizing an aiming apparatus (e.g., a laser or other relatively more expensive aiming device) that remains strapped to a disrupter tool during firing; such strapped-on aiming apparatus' may be destroyed during firing. In addition, by maintaining operative attachment of the reflector to the disrupter tool after alignment and aiming, and through firing, no additional system or process disturbances of the disrupter tool are introduced, and the disrupter tool remains aligned and aimed with the target.

The foregoing description of the embodiments of the invention has been presented for the purpose of illustration; it is not intended to be exhaustive nor does it limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. A method of deploying a precision laser aiming system, the method comprising: stabilizing a disruptor tool at a disruptor setup area, wherein the disruptor tool comprises a muzzle, and wherein the muzzle comprises a muzzle opening and a muzzle axis, wherein the muzzle axis extends in a collinear orientation along a z-axis center of the muzzle; attaching a reflector in front of the muzzle opening; orienting a first reflective broadside of a reflector away from the disruptor tool and towards a target; aligning a reflective axis of the reflector to be collinear with the muzzle axis, wherein the reflective axis extends in a collinear orientation along a z-axis center of the reflector, and wherein the reflective axis is orthogonal to the first reflective broadside; executing rough aiming of the disruptor tool by orienting the muzzle generally towards the target; configuring a laser fixture comprising a laser support structure wherein a first laser comprising a first laser beam is inserted within a first end cavity, and a second laser comprising a second beam is inserted within a second end cavity; and wherein the first laser beam is collinearly aligned with the second laser beam; and wherein the first laser beam is pointed in a first direction, and the second laser beam is pointed in a second direction, wherein the second direction is substantially oriented 180 degrees from the first direction; positioning the laser fixture at a laser fixture setup area wherein the laser fixture setup area is further located generally midway between the disruptor tool and a target; stabilizing the laser fixture at the laser fixture setup area; and directing the first laser beam of the laser fixture to contact a desirable location on the target.

2. The method of claim 1, further comprising:

executing fine alignment of the laser fixture by maintaining the directing of the first laser beam to the desirable location on the target while also moving the laser fixture in generally small increments and directing the second laser beam of the laser fixture to contacting a first reflective point on the first reflective broadside of the reflector and reflecting a first reflected laser beam back towards the laser fixture;

maintaining the directing of the first laser beam to the desirable location on the target, and further moving the laser fixture in generally small increments and directing the second laser beam to contacting a second reflective point on the first reflective broadside and directing the first reflected laser beam to contacting a first aligning hit point on a laser finding plate; and maintaining the directing of the first laser beam to the desirable location on the target, and moving the laser fixture still further in generally small increments and directing the second laser beam to contacting a third reflective point on the first reflective broadside and directing the first reflected laser beam to contacting a second aligning hit point on the laser finding plate, wherein the second aligning hit point is closer to a center hole on the laser finding plate than the first aligning hit point.

3. The method of claim 2, further comprising:

executing fine aiming of the disrupter tool by moving the disrupter tool in generally small increments and directing the first reflected laser beam until the first reflected laser beam is aligning through the center hole of the laser finding plate and determining a completely aligned and aimed disrupter tool;

removing the laser fixture from the laser fixture setup area; and firing the disrupter tool at the target.

4. The method of claim 2, further comprising:

executing fine aiming of the disrupter tool by moving the disrupter tool in generally small increments and directing the first reflected laser beam to contacting a third aligning hit point on the laser finding plate, wherein the third aligning hit point is closer to the center hole of the laser finding plate than the second aligning hit point.

5. The method of claim 4, further comprising:

executing further fine alignment of the laser fixture by maintaining the directing of the first laser beam to the desirable location on the target, and further moving the laser fixture in generally small increments and directing the second laser beam to contacting a next reflective point on the first reflective broadside, and directing the first reflected laser beam to contacting a next aligning hit point on the laser finding plate, wherein the next aligning hit point is closer to the center hole of the laser finding plate than the third aligning hit point.

6. The method of claim 5, further comprising:

executing further fine aiming of the disruptor tool by further moving the disruptor tool in generally small increments and directing the first reflected laser beam until the first reflected laser beam is aligning through the center hole on the laser finding plate and determining a completely aligned and aimed disruptor tool;

removing the laser fixture from the laser fixture setup area; and firing the disruptor tool at the target.

7. The method of claim 4, further comprising:

executing further fine alignment of the laser fixture by maintaining the directing of the first laser beam to the desirable location on the target, and further moving the laser fixture in generally small increments and directing the second laser beam to contacting a next reflective point on the first reflective broadside, and directing the first reflected laser beam until the first reflected laser beam is aligning through the center hole on the laser finding plate and determining a completely aligned and aimed disrupter tool;

removing the laser fixture from the laser fixture setup area; and firing the disrupter tool at the target.

8. The method of claim 4, further comprising:

executing further fine alignment of the laser fixture and executing further fine aiming of the disrupter tool and directing the second laser beam to contacting a next reflective point on the first reflective broadside and directing the first reflected laser beam until the first reflected laser beam is aligning through the center hole of the laser finding plate and determining a completely aligned and aimed disrupter tool;

removing the laser fixture from the laser fixture setup area; and firing the disrupter tool at the target.

9. The method of claim 2, further comprising:

executing fine aiming of the disrupter tool by moving the disrupter tool in generally small increments and directing the first reflected laser beam to contacting a sufficient aligning hit point on the laser finding plate, wherein the sufficient aligning hit point is closer to the center hole of the laser finding plate than the second aligning hit point, and wherein the sufficient aligning hit point is sufficiently close to the center hole of the laser finding plate and determining a sufficiently aligned and aimed disrupter tool;

removing the laser fixture from the laser fixture setup area; and firing the disrupter tool at the target.

10. The method of claim 2, further comprising:

executing fine aiming of the disrupter tool by moving the disrupter tool in generally small increments and directing the first reflected laser beam to contacting a third aligning hit point on the laser finding plate, wherein the third aligning hit point is closer to the center hole of the laser finding plate than the second aligning hit point.

11. The method of claim 10, further comprising:

executing further fine alignment of the laser fixture by maintaining the directing of the first laser beam to the desirable location on the target, and further moving the laser fixture in generally small increments and directing the second laser beam to contacting a next reflective point on the first reflective broadside, and directing the first reflected laser beam to contacting a sufficient aligning hit point on the laser finding plate, wherein the sufficient aligning hit point is closer to the center hole of the laser finding plate than the third aligning hit point, and wherein the sufficient aligning hit point is sufficiently close to the center hole of the laser finding plate and determining a sufficiently aligned and aimed disrupter tool;

removing the laser fixture from the laser fixture setup area; and firing the disrupter tool at the target.

12. The method of claim 10, further comprising:

executing further fine alignment of the laser fixture and executing further fine aiming of the disrupter tool by maintaining the directing of the first laser beam to the desirable location on the target, and directing the second laser beam to contacting a next reflective point on the first reflective broadside and directing the first reflected laser beam to contacting a sufficient aligning hit point on the laser finding plate, wherein the sufficient aligning hit point is closer to the center hole of the laser finding plate than the third aligning hit point, and wherein the sufficient aligning hit point is sufficiently close to the center hole of the laser finding plate and determining a sufficiently aligned and aimed disrupter tool;

removing the laser fixture from the laser fixture setup area; and firing the disrupter tool at the target.

13. A precision laser aiming system, comprising:

a disrupter tool comprising a muzzle;

a reflector comprising at least one reflective broadside; and a laser fixture comprising a laser support structure comprising a first laser comprising a first laser beam, a second laser comprising a second laser beam, and a laser finding plate.

14. The precision laser aiming system of claim 13, wherein the precision laser aiming system further comprises a disrupter tool mounting apparatus adaptable for positioning the disrupter tool.

15. The precision laser aiming system of claim 13, wherein the precision laser aiming system further comprises a laser fixture mounting apparatus adaptable for positioning the laser fixture.

16. The precision laser aiming system of claim 15, wherein the laser support structure comprises a bottom surface, and at least one threaded hole, wherein the first threaded hole is evacuated through the bottom surface; and wherein the first threaded hole comprises threads, wherein the threads are adapted to receive a mounting screw of the laser fixture mounting apparatus; and wherein the mounting screw is threadably engaged with the first threaded hole, and wherein the laser fixture mounting apparatus is secured to the bottom surface of the laser support structure.

17. The precision laser aiming system of claim 13, wherein the laser support structure further comprises at least one top surface, a first end surface, a first end cavity, a first set of adjustment screws, a second end surface, a second end cavity, a second set of adjustment screws, a first side surface, a second side surface and a third side surface, at least one slit and at least one slit width; wherein the first slit is evacuated in a linear manner between the second side surface and third side surface; and wherein the first slit width is determined by a first tightening adjustment action and a first loosening adjustment action of the first set of adjustment screws; and wherein the second slit width is determined by a second tightening adjustment action and a second loosening adjustment action of the second set of adjustment screws.

18. The precision laser aiming system of claim 17, wherein the first laser is inserted within the first end cavity, and the second laser is inserted within the second end cavity; and wherein the first laser beam is collinearly aligned with the second laser beam; and wherein the first laser beam is pointed in a first direction, and the second laser beam is pointed in a second direction, wherein the second direction is substantially oriented 180 degrees from the first direction; and wherein the first tightening adjustment action of the first set of adjustment screws secures the first laser and the first loosening adjustment action of the first set of adjustment screws unsecures the first laser; and wherein the second tightening adjustment action of the second set of adjustment screws secures the second laser and the second loosening adjustment action of the second set of adjustment screws unsecures the second laser.

19. The precision laser aiming system of claim 13, wherein the laser finding plate comprises a first broadside, a second broadside, an outer edge surface, a center hole, and at least one laser finding plate attaching means, wherein the laser finding plate attaching means is located on the first broadside.

20. The precision laser aiming system of claim 19, wherein the laser finding plate is secured to the second end surface of the laser support structure by the first laser finding plate attaching means; wherein the second laser beam is directed through the center hole of the laser finding plate, and wherein the second laser beam is oriented generally orthogonally relative to the second broadside of the laser finding plate.

21. The precision laser aiming system of claim 13, wherein the muzzle further comprises a muzzle opening and a muzzle axis, wherein the muzzle axis extends in a collinear orientation along a z-axis center of the muzzle; and wherein the reflector further comprises a reflector attaching means and a reflective axis, wherein the reflective axis extends in a collinear orientation along a z-axis center of the reflector, and wherein the reflective axis is orthogonal to the first reflective broadside.

22. The precision laser aiming system of claim 21, wherein the first reflective broadside of the reflector is oriented towards a target, and wherein the reflector attaching means is operatively attached to the muzzle opening wherein the reflective axis is aligned to be collinear with the muzzle axis.

23. The precision laser aiming system of claim 13, wherein the laser fixture is positioned in a laser fixture setup area wherein the laser fixture setup area is located along a visual line between the disrupter tool and a target; and wherein the laser fixture setup area is further located generally midway between the disrupter tool and the target.

* * * * *